United States Patent [19]

Bullock, III

[11] Patent Number: 4,506,797

[45] Date of Patent: Mar. 26, 1985

[54] WINE BOTTLE COVER

[75] Inventor: Joseph J. Bullock, III, Atherton, Calif.

[73] Assignee: Three Sisters Ranch Enterprises, San Jose, Calif.

[21] Appl. No.: 533,249

[22] Filed: Sep. 19, 1983

[51] Int. Cl.[3] ..... B65D 41/32

[52] U.S. Cl. ..... 215/256; 215/258

[58] Field of Search ..... 215/253, 256, 258; 220/270, 276

[56] References Cited

U.S. PATENT DOCUMENTS

| | | | |
|---|---|---|---|
| 3,809,365 | 5/1974 | Loffler | 215/253 |
| 4,109,816 | 8/1978 | Faulstich | 215/256 |
| 4,391,383 | 7/1983 | Babiol | 215/256 |

*Primary Examiner*—George T. Hall

*Attorney, Agent, or Firm*—Julian Caplan

[57] ABSTRACT

A plastic cover fits over the top and partially down the sides of a corked wine bottle. Such a bottle conventionally has an external bead a short distance below the top of the neck. The cover has a skirt formed with a complementary bead which fits tightly over such bead, the plastic material stretching sufficiently for the cover to lock into place so that it cannot be removed with the skirt intact. A tear strip is formed substantially circumferentially around the cap bead by a pair of vertically spaced score-lines. The skirt is grooved to form a tear tab which extends circumferentially along a portion of the bottle bead. By tearing off the tear strip the portion of the cap thereabove can be removed. As a supplemental means of access for removal of the cork, the top disc of the cap may be formed with a circular score-line.

8 Claims, 5 Drawing Figures

WINE BOTTLE COVER

This invention relates to a new and improved wine bottle cover formed of a stretchable material so constructed as to prevent removal of the cork from the bottle without providing indication of tampering.

It has been customary to cover the tops of wine bottle necks with seals to indicate tampering with the contents of the bottle. For many years, such seals were of metal foil. More recently, plastic covers have been commercially used. One common type cover has a circulate score-line on the top disk of which fractures when the cork is pulled, or may be broken to free a circle of plastic material which exposes the end of the cork. Other plastic covers are grooved to provide a tongue which may be torn around the cover at the top of the neck to free a circle of material which would otherwise cover the cork.

The present invention supplements, or replaces, caps which have score-lines in the top disc. A tear strip is provided around the cap skirt at the location of the conventional bead on the exterior of the neck. A tear tab is integral with the end of the strip and is formed by a U-shaped groove in the skirt which defines the tab.

A feature of the invention is the fact that a portion of the cap remains on the neck and functions as a neck band and may contain the name of the bottler or the variety or a decoration.

Reference is made to Faulstich U.S. Pat. No. 4,109,816 which combines a neck cover with a corking skirt and eliminates the need of a cork. In such usage, the cap must be liquid tight. Accordingly, in the aforesaid patent, the tear tab which is used to remove the tear strip from the skirt is external rather than comprising an extension of the tear tab as in accordance with the present invention. External tear tabs have certain disadvantages. One is that it is difficult to construct a mold to produce a cap with such a tab integral therewith. Another disadvantage is that the tab sometimes breaks off before the tear strip is completely removed. These difficulties are eliminated in accordance with the present invention.

Other objects of the present invention will become apparent upon reading the following specification and referring to the accompanying drawings in which similar characters of reference represent corresponding parts in each of the several views.

Figure 1:
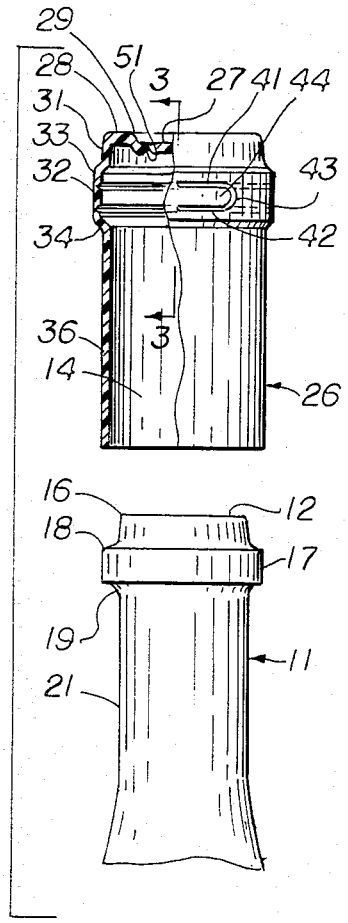
FIG. 1 is an exploded side elevational view partially broken away in section showing the cap prior to being installed on the neck of a wine bottle.
Figure 2:
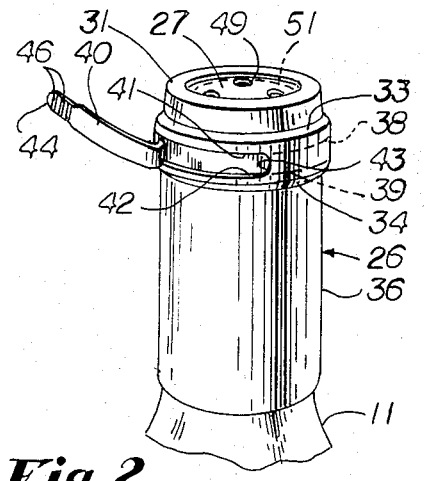
FIG. 2 is a perspective view of the tear strip partially removed.

A conventional wine bottle neck 11 has a lip 12 from which depends a substantially cylindrical inside wall 13 which may be filled with a cork 14, the top edge of which is depressed slightly below the lip 12.

Considering now the exterior of the neck 11, below the lip 12 is a slightly outwardly-downwardly slanted conical outside wall 16 and below the wall 16 is an external bead 17. There is a slanted surface 18 between the surface 16 and the exterior of the bead 17 and a downward slanted surface 19 below the bead 17. Surface 19 merges with a cylindrical lower wall 21.

Overcap 26 of the present invention has a top disc 27 which fits against the top of cork 14. Top rim 28 fits over the lip 12, there being a slanted surface 29 between the disc 27 and rim 28. Below rim 28 is a conical outside wall 31 which fits against the wall 16 merging into a bead 32 which fits over the bead 17. Top slanted wall 33 fits over the surface 18 and inward extending wall 34 fits over the surface 19. Below the wall 34 is the remainder of the skirt 36.

The material of construction of the overcap 26 is such that by use of conventional capping machinery, it may be pushed onto the neck 11, the cap 26 stretching to enable the skirt 36 and slanted wall 34 to expand over the bead 17. Once in place, the cap 26 may not be removed without indicating tampering. The cork 14 may not be removed without in some way fracturing the overcap 26.

One means of opening the overcap is the provision of two circumferentially vertically spaced apart top and bottom score-lines 38 and 39 which are indented substantially circumferentially around the inside surface of the cap bead 32 and define tear strip 40.

At one end of the tear strip 40 is a tead tab 44 which is an extension of the strip 40 between the score-lines 38 and 39. Thus, there is a horizontal top groove 41 which merges into a semi-circular groove 43 which, in turn, merges into a bottom horizontal groove 42. Gripper ridges 46 may be formed on the inside of the tab 44.

Figure 4:
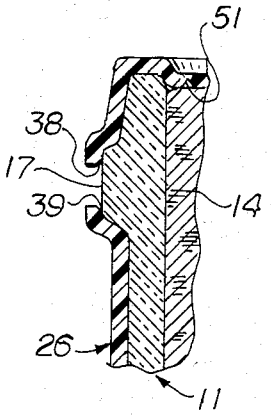
FIG. 4 is a view similar to FIG. 3 showing the tear strip removed.

Thus, by gripping the tab 44 and pulling it around the neck 11 the score-lines 38 and 39 cause the tear strip 40 to fracture. The overcap then has the appearance of FIG. 4. The portion above the bead 17 may be pulled off and a corkscrew used to remove the cork 14. Although the tab 44 is shown tearing in a clockwise direction as viewed from the top of the bottle, nevertheless it will be understood that the tear tab 44 might be so constructed as to pull counterclockwise.

Because corks 14 do not hermetically seal the contents of the wine bottle, it is customary to form breather holes 49 in the top disc 27. This permits gases produced inside the bottle to escape through the cork and through the disc 27.

As a supplement to or a replacement of the grooves 38, 39, a groove 51 may be formed in the underside of top disc 27 as close as possible to the inside wall 13. The top disc 27 is sufficiently soft so that a corkscrew may be driven through it and into the cork 14. By pulling up on the corkscrew, the top disc 27 fractures around the circle 51 and the cork 14 may be pulled out of the neck 11.

Figure 3A:
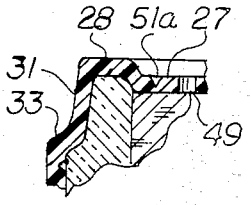
FIG. 3A is a view similar to FIG. 3 showing the circular groove on the top disc on the top side rather than on the underside.
Figure 3:
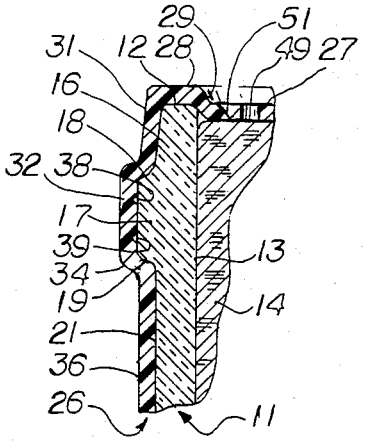
FIG. 3 is an enlarged, vertical sectional view through a portion of the cover, bottle neck and cork after the cover has been put in place.

FIG. 3A is similar to the structure shown in FIG. 3 except that the groove **51*a* is on the top side of the disc 27 rather than on the underside as shown in FIG. 3**.

The score-lines 51 or **51*a* provide an alternate means of access to the cork 14 in the event that the user does not wish to use the tear tab 44** or if, for some reason, the tear strip does not properly tear away.

What is claimed is:

1. A wine bottle overcap formed of a thin-walled plastic material comprising a top disk and a peripheral skirt depending from said disk formed with an external first bead having parallel top and bottom bead edges, said first bead being shaped to conform tightly to the second external bead of a conventional wine bottle neck, an upper score-line extending substantially circumferentially around said first bead spaced below said top bead edge, a lower score-line parallel to said first score-line extending substantially around said first bead spaced above said bottom bead edge, said score-lines defining a tear strip positioned intermediate said top and bottom bead edges, a top groove in said first bead comprising an extension of said upper score-line, a bottom groove in said first bead comprising an extension of said lower scoreline and a third groove in said first bead joining ends of said upper and lower grooves, said upper, lower and third grooves comprising a tear tab, whereby upon pulling said tear tab outward and away from said skirt, said skirt is torn away around said first bead.

2. A cover according to claim 1 which further comprises a circular disk score-line in said disk of about the diameter of a conventional wine bottle cork, said disk having a rim elevated above the remainder of said disk and having a width about equal to the thickness of the lip of a conventional wine bottle, said circular disk scoreline being inside said rim.

3. A cover according to claim 2 in which said circular disk score-line is on the underside of said disk.

4. A cover according to claim 2 in which said circular disk score-line is on the upper side of said disk.

5. In combination, a cover according to claim 1 and a wine bottle having a neck formed with said external second bead and an external wall formed complementary to the interior of said skirt and a cylindrical inside wall closed with a cork.

6. The combination of claim 5 which further comprises a circular disk score-line in said disk of about the diameter as said wine bottle cork, said neck having a lip and the top of said cork being below the level of said lip and said disk having a rim elevated above the remainder of said disk and having a width about equal to the thickness of said lip, said circular disk scoreline being inside said rim.

7. The combination of claim 6 in which said circular disk score-line is on the underside of said disk.

8. The combination of claim 6 in which said circular disk score-line is on the upper side of said disk.

* * * * *